United States Patent [19]

Daikoku et al.

[11] 4,207,550

[45] Jun. 10, 1980

[54] WINDING STRUCTURE OF ELECTRIC DEVICES

[75] Inventors: Takahiro Daikoku, Ushikumachi; Wataru Nakayama, Kashiwa; Taisei Uede, Hitachi, all of Japan

[73] Assignee: Hitachi, Ltd., Japan

[21] Appl. No.: 880,422

[22] Filed: Feb. 23, 1978

[51] Int. Cl.[2] ..... H01F 27/08

[52] U.S. Cl. ..... 336/60

[58] Field of Search ..... 336/57, 58, 60, 185, 336/207

[56] References Cited

U.S. PATENT DOCUMENTS

| | | | |
|---|---|---|---|
| 3,548,354 | 12/1970 | Schwab | 336/60 X |
| 3,902,146 | 8/1975 | Muralidharan | 336/60 X |
| 4,000,482 | 12/1976 | Staub et al. | 336/60 |

FOREIGN PATENT DOCUMENTS

| | | | |
|---|---|---|---|
| 46-15364 | 5/1971 | Japan | 336/60 |
| 49-27416 | 8/1974 | Japan | 336/60 |

*Primary Examiner*—Thomas J. Kozma

*Attorney, Agent, or Firm*—Craig and Antonelli

[57] ABSTRACT

A plurality of winding units mounted about a magnetic core structure, each of which consisting of wound wire elements, are disposed and stacked in an annular space defined by a coaxial inner and outer insulating sleeves, so as to form a winding structure for electric devices. Vertical passages for cooling fluid are defined at both sides of the winding units, while horizontal passages for the cooling fluid are formed between adjacent winding units. A plurality of peripherally continuous flow controlling bodies are disposed in either one of the vertical passages at a two vertical pitches of the winding unit, so as to confront alternating ones of the winding units. Alternatively, the flow controlling bodies are disposed alternatingly in both vertical passages, in such a manner that the flow controlling bodies disposed in one of the vertical passages confront alternating ones of said winding units which are not confronted by the flow controlling bodies disposed in the other vertical passage. These flow controlling bodies are effective to induce flows of the cooling fluid in opposite directions and of substantially same velocity, in two horizontal passages separated by the winding unit which is confronted by the flow controlling body.

9 Claims, 14 Drawing Figures

WINDING STRUCTURE OF ELECTRIC DEVICES

BACKGROUND OF THE INVENTION

1. Field of the Invention

The present invention relates to windings for electric devices such as transformers, reactors, super conductive devices and so forth, and, more particularly, to windings wound into a disk-like form or a helical form having an improved cooling effect.

2. Description of the Prior Art

Before turning to the description of the embodiments of the invention, an explanation will be made here as to the prior arts, in order to clarify the drawbacks of the prior art which are to be overcome by the present invention, in reference with FIGS. 1 and 2.

FIG. 1 is a schematic vertical cross-sectional view of conventional disk-coil windings for a transformer, as an example of conventional windings, while FIG. 2 is a sectional view of the windings as shown in FIG. 1 taken along a horizontal plane and showing a disk winding unit and concentric insulating sleeves disposed at the inner and outer sides of the disk winding units.

As will be seen from FIGS. 1 and 2, conventional windings of transformer have a plurality of disk winding units 4 stacked one on another. Each disk winding unit 4 consists of a conductive wire element 4*a* wound and disposed in an annular gap formed between an inner insulating sleeve 2 and an outer insulating sleeve 3 which are disposed around a magnetic core structure iron 1. Cooling passages 5 extending in the horizontal direction (referred to as horizontal cooling passage, hereinafter) are formed by horizontal duct pieces, between adjacent winding units 4. Similarly, cooling passages 6, 7 extending in the vertical direction (referred to as vertical cooling passages, hereinafter) are formed between the winding unit 4 and the inner insulating sleeve 2, and between the winding unit 4 and the outer insulating sleeve 3, by means of respective vertical duct pieces (not shown) extending in the vertical direction. A cooling fluid such as insulating oil is circulated through these passages by means of a pump 8 or the like, so as to cool the winding.

In the forced-cooled disk-like winding, the barrier inserts 10, 11 are disposed at a vertical spacing of several of disk windings, having alternatingly arranged fluid inlets and outlets, in the inner and the outer vertical cooling passages 6, 7. By a pair of the said barrier inserts one cooling zone is formed. Therefore, the cooling fluid flows in a zig-zag manner, from the inner vertical cooling passages 6 of the outer vertical cooling passages 7 and vice versa, so that the fluid flow may be turned at each time it passes one cooling zone. Due to the provision of these barrier inserts, the cooling fluid flow shunting from one 6 (or 7) of the vertical cooling passages to the other 7 (or 6) through the horizontal cooling passage defined between the winding units 4.

However, in the disk-like windings having the described cooling passages, it is to be pointed out that the winding units 4 within one cooling zone defined by adjacent barrier inserts 10, 11 are not cooled uniformly. Namely, the lower winding units closer to the inlet of the cooling fluid are not sufficiently cooled, as compared with the upper winding units disposed close to the outlet of the fluid, due to the presence of these barrier inserts. More specifically, the velocities of the cooling fluid through the plurality of horizontal passages formed in one cooling zone are all different, and the flow rates through lower horizontal passages are much smaller than those through the upper horizontal passages. Therefore, the uniform temperature distribution over all winding units is not obtained to an acceptable extent, even by the zig-zag flow of the cooling fluid, so as to cause a local temperature rise in each cooling zone, resulting in a deterioration of the insulation and a shortened life of the winding.

FIGS. 3 thru 6 inclusive show other examples of conventional winding for electric devices.

The winding structure as shown in FIG. 3 has been disclosed in the specification of U.S. Pat. No. 4,000,482 (Ser. No. 645,562) by Ramachaudran, entitled "TRANSFORMER WITH IMPROVED NATURAL CIRCULATION FOR COOLING DISC COILS". In this winding structure, ring-shaped partial flow barrier inserts 12 are attached to the end surface of the winding unit 4, in place of the barrier inserts 10, 11 of FIG. 2, so that each winding unit may constitute one cooling zone and that the cooling fluid may flow in a zig-zag manner through respective cooling zones.

These barrier inserts 12 do not completely close the cross-sections of the inner and the outer vertical cooling passages 6, 7, but are arranged to leave slight gaps 13 between itself and the inner and the outer insulating sleeves 2, 3. However, unfortunately, an uniform flow distribution over the all horizontal passages cannot be obtained even by the provision of these gaps 13. It is possible to decrease the pressure loss across the gap 13, by enlarging the gap 13, thereby to improve the velocity distribution over the all horizontal passages to some extent. However, to the contrary, the zig-zag component of the fluid flow is weakened correspondingly, so as to decrease the velocity of the fluid flow through the horizontal passages.

On the contrary, when the gap 13 is made too small, the pressure loss across the latter will increase to make the flow velocity distribution over all horizontal passages.

Various measures have been taken to overcome or avoid above stated difficulty in cooling the coil windings uniformly.

According to one of these measures, the electric device is used with a reduced density of the electric current through the winding element. As an alternative measure, the electric device is designed on the basis of the cooling condition of the horizontal passages 5 of the smallest flow velocity and, accordingly, the smallest flow rate, among the horizontal passages 5 of the device.

However, these measures are found impractical, because the size of the device is rendered unacceptably large.

As still another measure, an improved winding structure as shown in FIGS. 4 and 5 has been disclosed in Japanese Utility Model Publication No. 15364/71 (Appln. No. 2020/68). In this winding structure, a plurality of winding units 4 form one cooling zone, through which the cooling fluid is passed in a zig-zag manner. Insulating bodies 14*a*–14*e*, and 15 for adjusting the flow rate of cooling fluid, the height of which being successively changed are disposed in the inner vertical passage 6 between the inner ends of the winding units of alternating one of the cooling zone and the confronting inner insulating sleeve 2, and in the outer vertical passage 7 between the outer ends of the winding units of the other cooling zone and the confronting outer insulating sleeve 3, thereby to gradually decrease the area of the vertical passages, thereby to achieve the uniform flow distribution of the fluid over all horizontal passages 5 between winding units 4. However, this arrangement has a drawback that the pressure loss of the fluid is inconveniently increased and that the passage structure is rendered highly complicated, due to the provision of the large number of flow-rate-adjusting insulating bodies 14*a*–14*e*, and 15.

Japanese Patent Laid-open Publication No. 27416/76 (Appln. No. 98953/74) discloses another winding structure for improving the cooling effect. More specifically, in this winding structure, the barrier inserts 10, 11 of FIG. 2 are substituted by a specific arrangement such that the radius of the winding units are suitably increased and decreased, so that the peripheral ends of alternating winding units may be radially projected into the inner and the outer vertical passages, as shown in FIG. 6.

According to this winding structure, the pressure of the fluid through the vertical passages 6, 7 is increased at portions below the peripheral ends of the winding units projecting into these passages, while the pressure is decreased at portions of the vertical passages 6, 7 above the projecting peripheral ends of the winding units, because the flow of the fluid is restricted and released at these portions, respectively. Consequently, a pressure differential is created across the inlet and outlet sides of each horizontal passage which, in combination with the sucking force provided by the viscosity of the fluid, induces a flow of fluid through each horizontal passage 5. However, this winding structure is disadvantageous in that the electric field is concentrated to the projecting peripheral edges of the winding units in case of a short-circuiting of the windings, due to the staggered projection of these peripheral edges, possibly resulting in a breakage of the winding structure. To the contrary, the winding structure has to be made large, in order to increase the withstand voltage of the windings.

SUMMARY OF THE INVENTION

It is therefore an object of the invention to provide a winding structure for electric devices in which the barrier inserts are eliminated to simplify the structure but still remaining a good flow of cooling fluid through respective horizontal passages between adjacent winding units, thereby to improve the cooling effect of the winding structure.

To this end, according to the invention, there is provided a winding structure having a plurality of winding units stacked one on another, each of said unit consisting of wire element wound in a space between an inner and an outer concentric insulating sleeve, horizontal passages defined between adjacent winding units, and vertical passages defined between the winding unit and the inner insulating sleeve and between the winding unit and the outer insulating sleeve, respectively, wherein peripherally continuous flow controlling bodies are provided in either one of the inner or the outer vertical passages at a true vertical pitched of a winding unit, so as to confront alternating one of the winding units, or flow controlling bodies are disposed alternatingly in staggered relation in the inner and outer vertical passages, so as to confront each winding units from its inner and outer sides alternatingly, so that the fluid may flow in the opposite directions through two horizontal passages above and below the winding unit confronted by the flow controlling body, thereby to improve the cooling effect of the winding structure.

According to another aspect of the invention, the breadth of the flow controlling bodies disposed in the vertical passages are adjustable, in accordance with the state of the flow of the cooling liquid through the vertical passages, so as to further improve the cooling effect.

DESCRIPTION OF THE PREFERRED EMBODIMENTS

Figure 7:
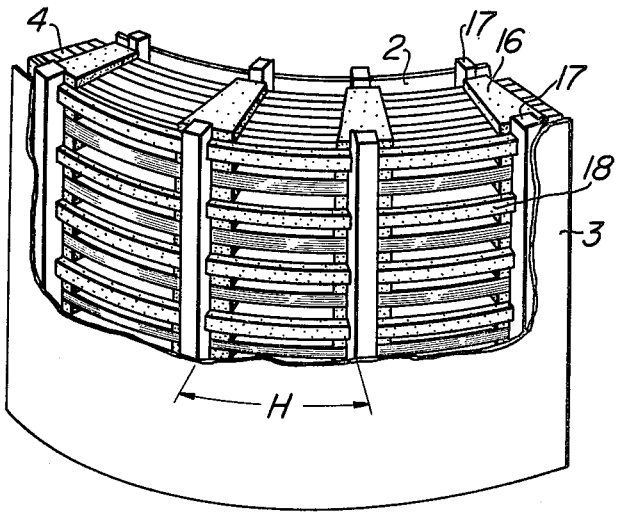
FIG. 7 is a partial perspective view of an embodiment of winding structure in accordance with the invention, showing specifically the essential part of the same.
Figure 8:
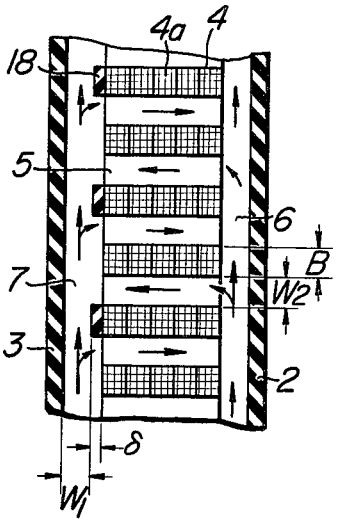
FIG. 8 is a schematic vertical cross-sectional view of the embodiment as shown in FIG. 7, showing the winding unit and the inner and the outer concentric insulating sleeves, and peripherally continuous flow controlling bodies.
Figure 9:
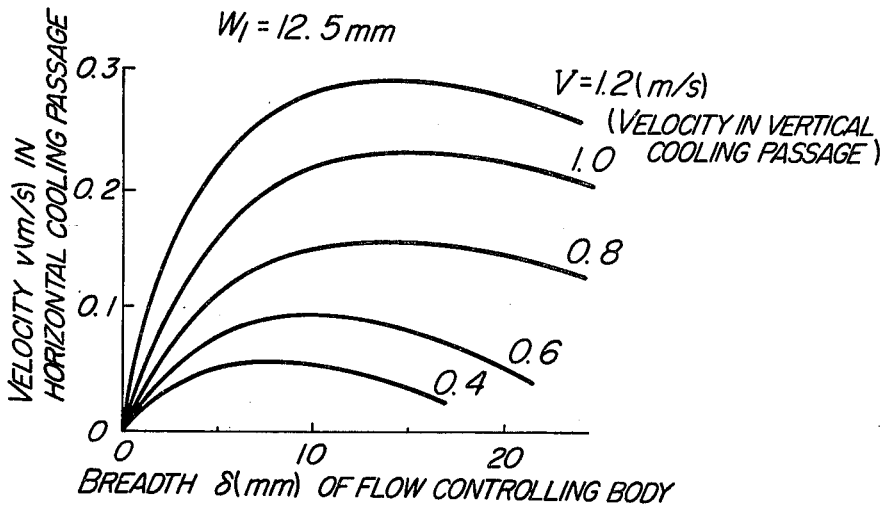
FIG. 9 is a chart showing a relationship between the breadth of a flow controlling body and the flow velocity through horizontal passage, in accordance with the invention.

FIGS. 7 to 9 show a disk coil winding structure of a transformer, embodying the present invention, in which same reference numerals are used to denote the same parts as those of conventional arrangement as shown in FIGS. 1 thru 6.

As will be seen from FIGS. 7 and 8, the winding structure has, as is the case of the conventional arrangement, a plurality of winding units 4 stacked one on another, each of units consisting of wire element 4*a* wound in a space defined between an inner insulating sleeve 2 and an outer insulating sleeve 3 which are disposed to surround an iron core 1.

Horizontal passages 5 are formed between adjacent winding units 4 at a constant circumferential pitch, by means of a plurality of horizontal duct pieces 16. Inner and outer vertical passages 6, 7 are formed in the spaces between the winding unit 4 and the inner insulating sleeve 2 and between unit 4 and the outer insulating sleeve 3, respectively, by means of a plurality of vertical duct pieces 17 which are arranged at corresponding circumferential pitch to that of the horizontal passages 5.

Flow controlling bodies 18 are positioned in the outer vertical passage 7 and are provided to confront peripheral ends of the alternating ones of the winding units 4, so as to ensure that the cooling fluid flows in opposite directions through two horizontal passages 5, 5 disposed above and below the winding unit 4. The flow controlling body is made of, for example, a webbing like insulating material such as a press board, and may be supported by a winding structural member such as the horizontal or vertical duct piece 16, 17 or may be bonded to the same. It will be seen that the cross-sectional area of the outer vertical passage 7 is narrowed at portions confronting the winding elements to which the flow controlling bodies are associated.

In the embodiment as shown in FIGS. 7 and 8, the flow controlling bodies are disposed only in the outer vertical passage 7. However, these flow controlling bodies may be disposed only in the inner vertical passage 6, or, as will be detailed later, may be provided alternatingly in staggered relation in the outer and the inner vertical passages at either side of the windings.

By restricting and enlarging alternatingly the cross-sectional area of the outer vertical cooling passage 7 for the successive winding units 4, by providing the flow controlling bodies 18 in the manner as illustrated in FIGS. 7 and 8, the flow of the cooling fluid which is directed upward as shown by arrows causes a high pressure at portions below the flow controlling bodies, because the flow passage is partially restricted at these portions, so that a shunting flow as shown by arrows is caused to get into the horizontal passage 5 at each of these portions.

On the other hand, the pressure of the fluid having passed through the passage partially restricted by the flow controlling bodies 18 is decreased, because the flow velocity is increased when the fluid passes through the restricted passages, so that an outward flow of liquid is induced in the horizontal passage 5 above the winding unit 4 confronted by the flow controlling body 18, as shown by arrows. The outward and inward components of fluid flow merge, after cooling the winding unit 4 contacting respective horizontal passages, into the main upward flows of the cooling fluid in the inner and the outer vertical passages, so as to discharge and deliver the heat, which has been picked up from the winding unit, to the main flows of the cooling fluid. The cooling of winding units are made as this cooling step is performed repeatedly for the successive winding units.

Thus, the plurality of winding units 4 disposed between the inner and the outer concentric insulating sleeves 2, 3 are effectively and uniformly cooled, by the shunting flows of the cooling fluids through respective horizontal passages caused by the flow controlling bodies 18 and by the vertical main flow of the cooling fluids through the inner and the outer vertical passages 6, 7.

Representing the radial extension of the flow controlling body 18 by $\delta$ and the radial width of the outer vertical passage 7 restricted by the controlling body 18, i.e. the distance between the radial outer end of the controlling body 18 and the inner wall of the outer insulating sleeve 3 by $W_1$, and assuming that the velocity of the fluid through the outer vertical passage is constant, the velocity v of the fluid flow controlling bodies 18 comes to assume its maximum value, when the breadth, i.e. the radial extension $\delta$ of the controlling body 18 is suitably selected, as will be seen from FIG. 9.

More specifically, FIG. 9 shows velocities v of the fluid through the horizontal passage, when the width $W_1$ of the restricted outer vertical passage is fixed at 12.5 mm, while the breadth $\delta$ of the flow controlling body 18 is changed, for each of five velocities V of the main fluid flow plotted at each 0.2 m/sec and 1.2 m/sec.

This phenomenon as shown in FIG. 9 can be attributed to the following reason. Namely, referring to FIG. 8, a recessed area is formed in the outer vertical passage 7, by the winding unit 4 and the flow controlling body 18. The above phenomenon will be explained more clearly upon hydrodynamic consideration on this recess. Namely, when the breadth of the flow controlling body 18 is too small, the recess is too shallow to induce a sufficient shunting flow. On the contrary, when the breadth of the flow controlling body 18 is too large, a swirling flow causes in this recess, resulting in the weakened component of the flow through the horizontal passage 5.

However, when the breadth of the flow controlling body is optimumly selected, a pressure distribution is formed in the recess to cause a strong shunting flow through the horizontal passages, so as to effectively cool the winding units 4.

The range of the optimum breadth $\delta$ is determined by the following equations (2) and (3), respectively, depending on whether the flow through the vertical passage is a laminar flow whose Reynold's number Re given by the following equation (1) is smaller than 2300, or a turbulent flow of a larger Reynold's number.

$$Re = \frac{\frac{2(H \times W_1)}{H + W_1} \times V}{\nu} \tag{1}$$

When the flow through the vertical passage is a laminar flow:

$$\delta = (0.05 \sim 0.8) \times 10^{-6} \cdot W_1^{0.4} \cdot W_2^{1.6} \cdot B^{0.3} \left(\frac{H}{H + W_1}\right) \cdot V \cdot \nu^{-1} \tag{2}$$

When the flow through the vertical passage is a turbulent flow:

$$\delta = (0.02 \sim 0.2) \times 10^{-6} \cdot W_1^{0.6} \cdot W_2^{1.7} \cdot B^{0.6} \left(\frac{H}{H + W_1}\right) \cdot V \cdot \nu^{-1} \tag{3}$$

In these equations, $W_2$ represents the width of the horizontal passage 5, B represents the height of the winding unit 4, H represents a circumferential breadth of the vertical passage 7, V represents the means velocity of the main flow through the vertical kinematic passage and $\nu$ represents the coefficient of viscosity of the cooling fluid.

From the calculation of above equations, it is derived that the maximum flow velocity v of the shunting flow through the horizontal passage 5 is obtained when the width $W_1$ is substantially equal to $\delta$, so as to ensure the most effective cooling of the winding units 4.

Figure 10:
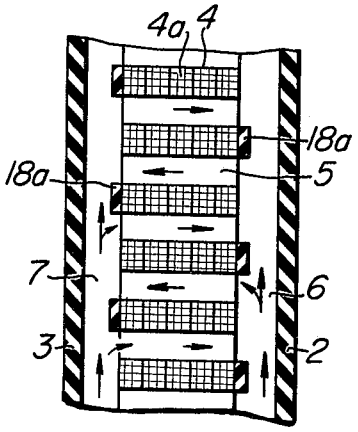
FIGS. 10 to 13 are schematic vertical cross-sectional views showing other winding structures embodying the present invention.

In another embodiment of the invention as shown in FIG. 10, in order to attain a further improvement of the cooling effect, the flow controlling bodies 18*a* are disposed alternatingly in staggered relation in the inner and the outer vertical passages 6, 7, at either side of each of the winding units 4. In other words, the flow controlling bodies in the inner vertical passage is provided for alternating ones of the winding units 4, while the flow controlling bodies in the outer vertical passages are provided for alternating other winding units 4.

According to this arrangement, the opposite flows of fluid through the horizontal passages 5 above and below the winding unit 4 are further enhanced as compared with those in the embodiment as shown in FIGS. 7 and 8, so as to ensure a correspondingly cooling effect.

Figure 1:
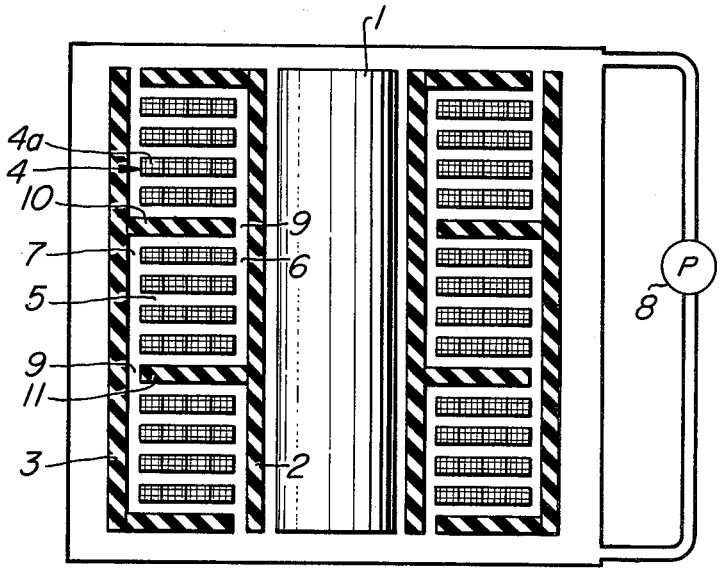
FIG. 1 PRIOR ART
FIG. 1 is a schematic vertical cross-sectional view of a conventional disk coil winding structure for electric devices.
Figure 2:
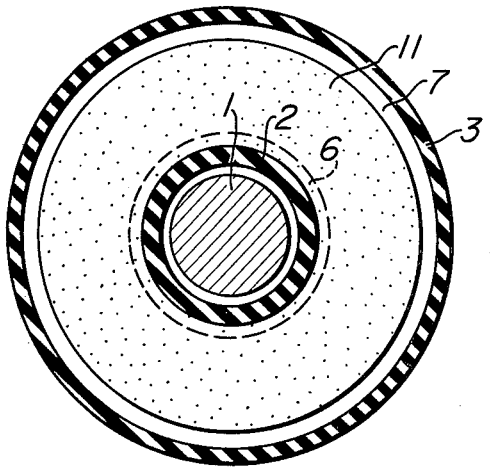
FIG. 2 PRIOR ART
FIG. 2 is a schematic horizontal cross sectional view of the disk coil winding structure as shown in FIG. 1, showing the winding unit and the inner and outer concentric insulating sleeves, and the inner barrier insert.
Figure 3:
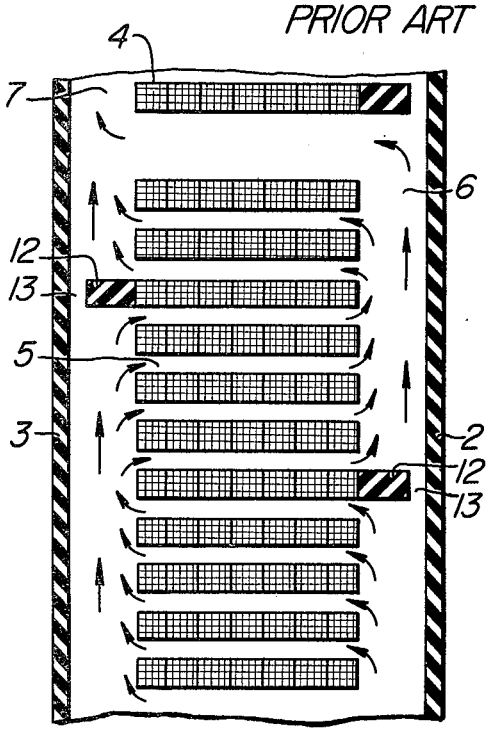
FIG. 3 PRIOR ART
FIGS. 3 to 6 are schematic vertical cross-sectional views of essential parts of other examples of conventional electric disk coil windings.
Figure 4:
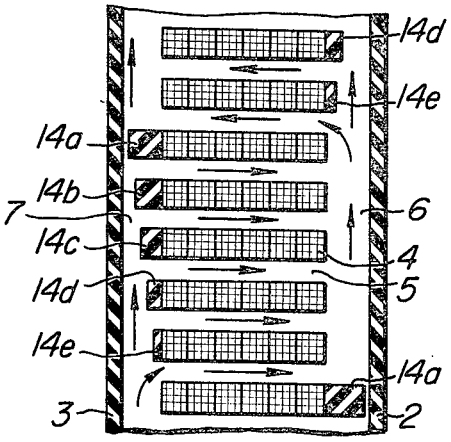
FIG. 4 PRIOR ART
Figure 5:
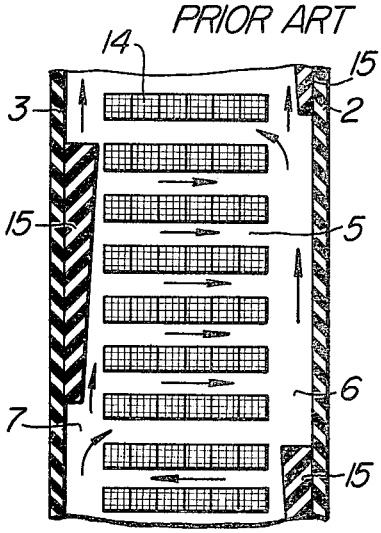
FIG. 5 PRIOR ART
Figure 6:
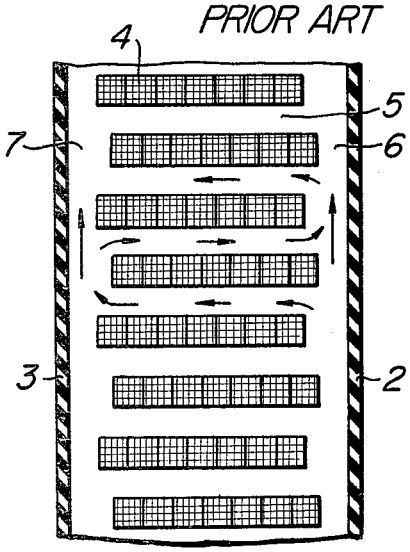
FIG. 6 PRIOR ART
Figure 14:
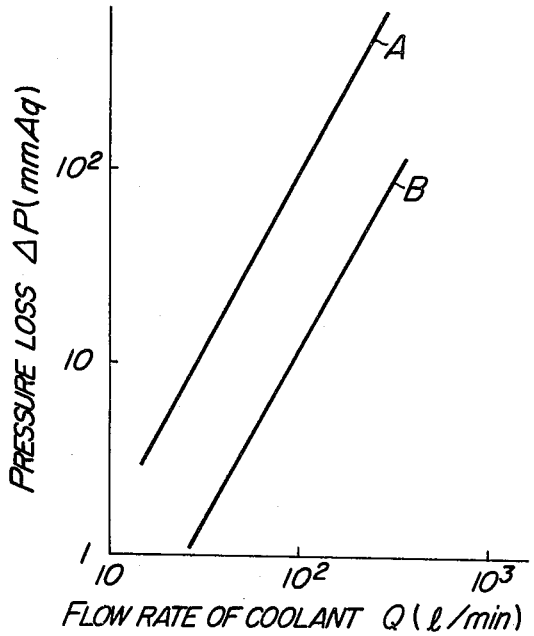
FIG. 14 is a chart showing the relationships between the flow rate of the cooling fluid and the pressure loss, in the winding structure as shown in FIG. 2 and in the winding structure as shown in FIG. 10.

FIG. 14 shows the relationship between the flow rate Q of the cooling fluid and the pressure loss $\Delta P$ in the winding structure as shown in FIG. 10, with the breadth $\delta$ of the flow controlling body 18*a* set at 5 mm, as well as the same relationship obtained by a conventional arrangement as shown in FIG. 2, in logarithmic scale. The winding structures used in the measurement were both constituted by 9 winding units each of which having a height of 15 mm and a breadth of 100 mm. The widths of the horizontal and vertical passages were 10 mm and 12.5 mm, respectively, in both winding structures.

The conventional winding structure as shown in FIG. 2 exhibited a characteristic as shown by a characteristic curve A, while a characteristic as shown by a characteristic curve B was obtained by an exemplar embodiment of the invention as shown in FIG. 10 in which the breadth $\delta$ of the flow controlling body 18*a* is selected to be 5 mm. It has be seen from the comparison of two curves with each other that the pressure loss in the winding structure of the invention as shown in FIG. 10 is as small as $\frac{1}{3}$ that of the conventional arrangement as shown in FIG. 2. Also, a flow rate which is two times as large as that of the conventional arrangement is obtained by the winding structure of the invention, provided that the same pressure differential is applied across the inlet and the outlet of the passage.

At the same time, the temperature rise of the wire element constituting the winding unit above the temperature of the cooling fluid was measured for both of the winding structures, the result of which is summarized in the following table.

| Structure of Cooling Passage | flow rate of cooling fluid | temperature rise of wire element | |
|---|---|---|---|
| Structure of Fig. 2 | 60 (l/min) | average | 24.0° C. |
| | | max. | 28.0° C. |
| Structure of Invention. 120 (l/min) (Fig. 10) | 60 (l/min) (equal flow rate) | average | 24.0° C. |
| | | max. | 24.5° C. |
| | (equal pressure loss) | average | 19.7° C. |
| | | max. | 20.0° C. |

heat flux q: $q = 2.85 \times 10^3$ (W/m$^2$)

It has be seen from the above table that the difference between the average temperature rise and the maximum temperature rise is considerably large, in the conventional arrangement as shown in FIG. 2, while the same difference is much smaller in case of the winding structure in accordance with the invention as shown in FIG. 10. This means that the winding units are cooled uniformly, because the maximum temperature, which incurs the local heating, is substantially equal to the average temperature. Furthermore, provided that the same pressure differential is applied across the fluid inlet and outlet, the flow rate of the fluid through the winding structure of the invention becomes two times as large as that of the conventional arrangement. Then, the average temperature, as well as the maximum temperature is drastically lowered as compared with those of the conventional arrangement, and the difference between the maximum temperature and the average temperature is much reduced, thus achieving a remarkably improved cooling effect.

Thanks to the improved cooling effect, the winding structure of the invention as shown in FIG. 10 affords various advantages such as reduced size and weight, prolonged life and enlargement of the capacity of the electric device incorporating the winding structure. Also, the size and the weight of the cooling means are conveniently reduced.

Figure 11:
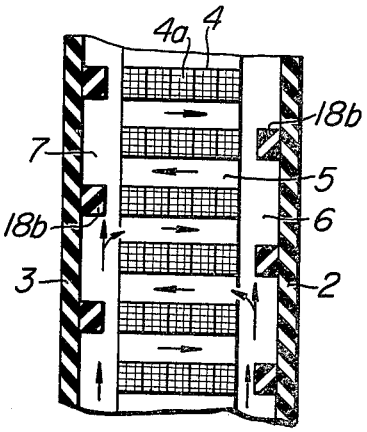

Still another embodiment of the invention is shown in FIG. 11. This winding structure differs from that of FIG. 10 only in that the flow controlling bodies 18*b* for causing the shunting flows through the horizontal passage 5 from the main flows of the cooling fluids through the vertical passages 6, 7 are provided in the vertical passages 6, 7 but closer to the walls of the inner and the outer concentric insulating sleeves 2, 3 or by vertical duct pieces (not shown), insteadly of being disposed on the end surfaces of the winding units 4 as is the case of the embodiment of FIG. 10.

Figure 12:
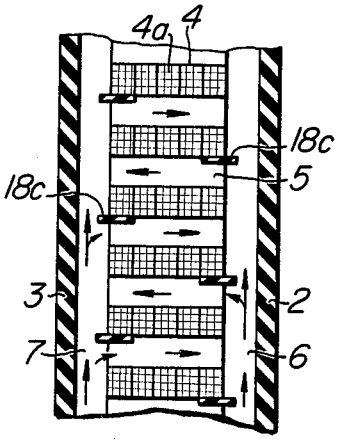
Figure 13:
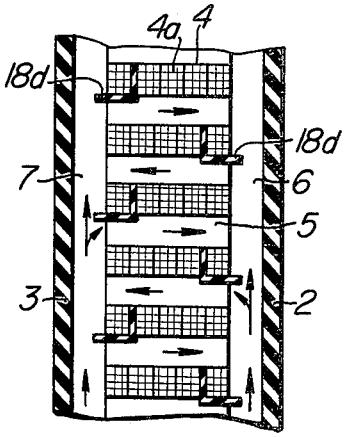

In further embodiments of the invention as shown in FIGS. 12 and 13, plate-like flow controlling bodies 18*c* and L-sectioned flow controlling bodies 18*d* are positioned, respectively, so as to confront the lower face of the winding units 4. These flow controlling bodies 18*c*, 18*d* can be supported by the horizontal duct pieces (not shown) or by the wire elements 4*a* themselves. These flow controlling bodies are effective to cause the opposite shunting flows of the cooling fluid through the two horizontal cooling passages defined above and below the winding unit 4 confronted by the body 18*c*, 18*d*, so as to ensure an equivalent cooling effect to that provided by the winding structure as shown in FIG. 10.

It is remarkable that the flows of the cooling fluids are induced in opposite directions through two horizontal passages separated by a winding unit, by placing flow controlling bodies in at least one of the vertical passages for alternating ones of the winding units in such a manner that the flow controlling bodies substantially confront these winding units, so as to cool the winding units more efficiently and uniformly, avoiding the local heating, than the conventional cooling passage structure which employ barrier inserts.

Therefore, the winding structure of the invention, as well as the cooling means associated with the latter can be made compact and light weight, contributing to enlarge the capacity of the electric devices incorporating the winding structures.

In addition, a further improvement of the cooling effect can be obtained by placing the flow controlling bodies alternatingly in staggered relation in the outer and the inner vertical passages at either side of each winding unit, so that the flow of fluid in each horizontal passage may be further promoted.

Furthermore, the cooling effect can be optimized without necessitating a substantial modification or rearrangement of the winding structures, by suitably selecting the breadth of the flow controlling bodies disposed in the vertical passages, depending on whether the main flow of the fluid through the vertical passage is a laminar flow or a turbulent flow.

Further, since the winding units are stacked in vertical alignment, without projecting laterally in a staggered manner, the strength of the winding structures against the short-circuitting is never deteriorated.

At the same time, the pressure drop of the fluid is considerably small, as compared with the case of conventional arrangements which incorporate, barrier inserts or insulating bodies for adjusting the flow rate of coolant.

Although the invention has been described with specific reference to the disc-like winding structure, it will be clear to those skilled in the art that the invention is applicable equally to the helical winding structures, ensuring the equivalent advantages.

For information, when the winding structure for electric devices in accordance with the invention is used in combination with other winding having a small flow resistance, e.g. a cylindrical winding, the cooling effect is further enhanced, because the distribution of the cooling fluid to the winding structures can be made in an easier manner than in the conventional arrangement.

What is claimed is:

1. A winding structure for an electric device comprising: an inner insulating sleeve; an outer insulating sleeve radially spaced from said inner insulating sleeve to define an annular space therebetween; a plurality of winding units stacked vertically and spaced from one another, said winding units being disposed in said annular space, horizontal cooling passages for cooling fluids defined between adjacent ones of said winding units; an inner vertical cooling passage and an outer vertical cooling passage defined between inner circumferential end surfaces of said respective winding units and said inner insulating sleeve and between outer circumferential end surfaces of said respective winding units and said outer insulating sleeve, respectively, said inner and outer vertical cooling passages communicating with each other through said horizontal cooling passages; and flow controlling bodies disposed in at least one of said inner and outer vertical cooling passages in a manner so as to extend circumferentially continuously and confront alternating ones of said winding units and having a radial breadth which is smaller than the radial breadth of said at least one of said vertical cooling passages, thereby ensuring that a part of the cooling fluid in said inner and outer vertical cooling passages flows in opposite directions through all immediately adjacent horizontal cooling passages.

2. A winding structure as claimed in claim 1, wherein said flow controlling bodies are disposed in only said at least one of said inner and outer vertical cooling passages in a manner so as to confront alternating ones of said winding units.

3. A winding structure as claimed in claim 2, wherein said flow controlling bodies are fixedly supported on the circumferential end surfaces, in said at least one passage, of said winding units.

4. A winding structure as claimed in claim 2, wherein said flow controlling bodies are fixedly supported on a wall of said inner insulating sleeve at portions confronting said alternating winding units.

5. A winding structure as claimed in claim 2, wherein said flow controlling bodies are fixedly supported on a wall of said outer insulating sleeve at portions confronting said alternating winding units.

6. A winding structure as claimed in claim 1, wherein said flow controlling bodies are disposed alternatingly in said inner and outer vertical cooling passages in a manner so that flow controlling bodies disposed in one of the vertical cooling passages confront alternating ones of said winding units which are not confronted by the flow controlling bodies disposed in the other vertical cooling passage.

7. A winding structure as claimed in claim 6, wherein said flow controlling bodies are fixedly supported on the circumferential end surfaces of said winding units.

8. A winding structure as claimed in claim 6, wherein said flow controlling bodies are fixedly supported on walls of respective insulating sleeves at portions confronting alternating winding units.

9. A winding structure as claimed in claim 1, wherein the radial breadth δ of each of said flow controlling bodies is selected to alternatively satisfy one of the following equations when the flow of cooling fluid in said vertical passages is a laminar flow and when said flow is a turbulent flow, respectively:

when the flow is a laminar flow:

$$\delta = (0.05\text{–}0.8) \times 10^{-6} \cdot W_1^{0.4} \cdot W_2^{1.6} \cdot B^{0.3} \left(\frac{H}{H + W_1}\right) \cdot V \cdot \nu^{-1}$$

when the flow is a turbulent flow:

$$\delta = (0.02\text{–}0.2) \times 10^{-6} \cdot W_1^{0.4} \cdot W_2^{1.6} \cdot B^{0.3} \left(\frac{H}{H + W_1}\right) \cdot V \cdot \nu^{-1}$$

where, $W_1$ represents the radial width of said vertical cooling passage restricted by said flow controlling body; $W_2$ represents the vertical width of each of said horizontal passages, i.e. the distance between every adjacent two of said winding units; B represents the vertical height of each of said winding units; H represents the circumferential breadth of said vertical cooling passage restricted by said flow controlling body; V represents the mean velocity of the fluid flow through said vertical cooling passage restricted by said flow controlling body and $\nu$ represents the coefficient of kinematic viscosity of the cooling fluid.

* * * * *